US006935762B2

(12) United States Patent
Van Dyn Hoven

(10) Patent No.: US 6,935,762 B2
(45) Date of Patent: Aug. 30, 2005

(54) LIGHT STRING ASSEMBLY

(75) Inventor: Victoria Jean Van Dyn Hoven, Stevens Point, WI (US)

(73) Assignee: Vickie Jean's Creations, Inc., Plover, WI (US)

( * ) Notice: Subject to any disclaimer, the term of this patent is extended or adjusted under 35 U.S.C. 154(b) by 0 days.

(21) Appl. No.: 10/723,628

(22) Filed: Nov. 26, 2003

(65) Prior Publication Data

US 2005/0111221 A1 May 26, 2005

(51) Int. Cl.[7] ..... F21V 33/00
(52) U.S. Cl. ..... 362/237; 362/236; 362/246; 362/810
(58) Field of Search ..... 362/235, 236, 362/237, 244, 246, 810

(56) References Cited

U.S. PATENT DOCUMENTS 3,435,286 A * 3/1969 Kayatt ..... 315/47
4,679,126 A * 7/1987 Van Sickler ..... 362/226
5,645,343 A 7/1997 Rinehimer
5,908,231 A * 6/1999 Huff ..... 362/96
6,033,088 A 3/2000 Contigiani
6,494,591 B1 * 12/2002 Guimond ..... 362/249
6,595,658 B2 7/2003 Tsai

OTHER PUBLICATIONS

Vickie Jean's Creations, Inc. Catalog, Jan. 1, 2002, 12 pages.
Vickie Jean's Creations, Inc. Catalog, 2002, 20 pages.
http://www.moonscent.net site, MOONSCENT Scented Candle Light Bulbs, 9 pages.

* cited by examiner

*Primary Examiner*—Laura K. Tso
(74) *Attorney, Agent, or Firm*—Foley & Lardner LLP

(57) ABSTRACT

A decorative light string assembly comprises a string of light bulb sockets electrically interconnected by an electrical cord and terminated by at least one electrical connector. A plurality of decorative light bulbs are mated with the sockets. Each decorative light bulb comprises a plain light bulb covered by a flexible outer coating in the shape of a candle flame. The decorative light bulbs may include colors or scents associated with particular holidays, seasons or occasions. A decorative light string assembly kit and a method for making a decorative light string assembly are also provided.

30 Claims, 2 Drawing Sheets

FIG. 1
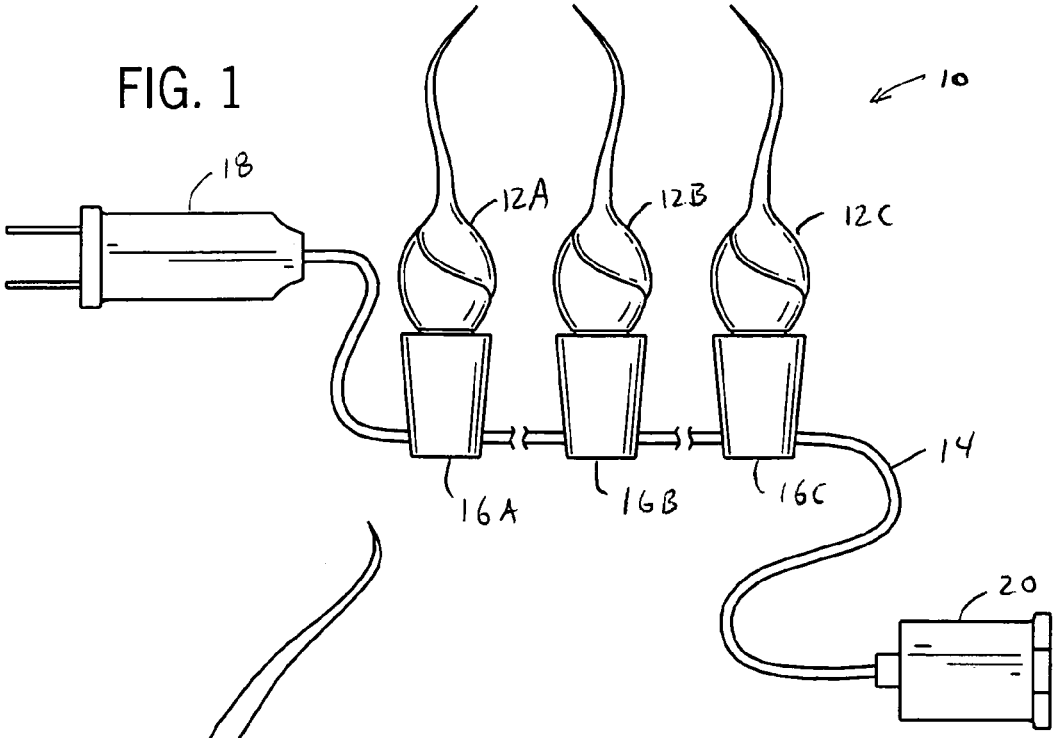
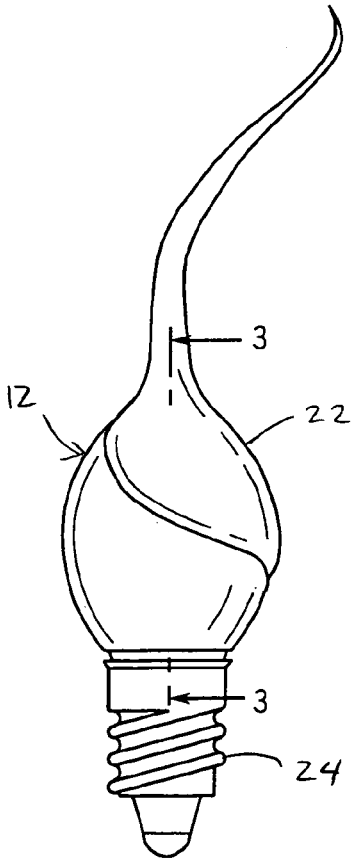
FIG. 2
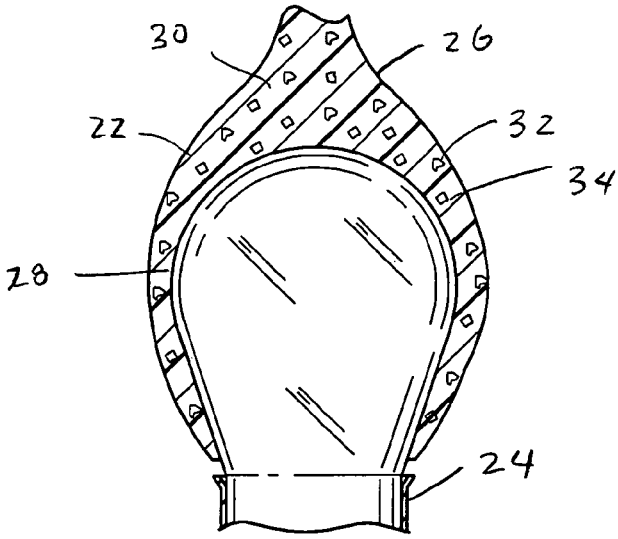
FIG. 3

LIGHT STRING ASSEMBLY

FIELD OF THE INVENTION

The present invention relates generally to decorative lights, and more particularly to strings of decorative lights having candle shaped bulbs. The invention further relates to strings of decorative lights that are readily adapted for display at different holidays, occasions and seasons.

BACKGROUND OF THE INVENTION

It is common for people to decorate their homes, offices and other locations for festive occasions such as holidays or even entire seasons. Such displays increase the festive atmosphere of the occasion and allow people to express their creativity and artistry.

Many holiday or seasonal displays include decorative lights which may be arranged individually or in strings. For example, decorative lights shaped as individual candles may be used to provide a room with the aesthetics and ambience of an actual candle flame, but without the associated risks or bother. According to one known construction of such candle lights, a 6 or 7 watt glass bulb may be coated with silicon gel, which may contain colored pigment or scent to further enhance the ambience.

Although individual decorative candle lights such as the above-described silicon construction are known in the art, such decorative lights have not heretofore been provided in strings. Moreover, due to the relatively high power consumption ratings of the bulbs typically used for such decorative candle lights, strings of such lights could not be provided without creating a potential fire hazard.

In view of the forgoing, it would be advantageous to provide candle shaped lights in strings. Moreover, it would further be desirable to provide strings of candle shaped lights that are readily adaptable to different occasions, holidays or seasons.

SUMMARY OF THE INVENTION

The present invention relates to strings of decorative lights having candle shaped bulbs and methods for making such light strings.

According to a first aspect of an embodiment of the present invention, a decorative light string assembly comprises a string of light bulb sockets electrically interconnected by an electrical cord and a plurality of decorative light bulbs mated with the sockets. The electrical cord has at least one end terminated by an electrical connector. Each decorative light bulb comprises a plain light bulb covered by a flexible outer coating in the shape of a candle flame.

According to another aspect of an embodiment of the present invention, a decorative light string assembly kit comprises a string of light bulb sockets electrically interconnected by an electrical cord and at least two sets of decorative light bulbs. The electrical cord has at least one end terminated by an electrical connector. Each decorative light bulb comprises a decorative portion and a base portion configured for mating with one of the sockets. Each decorative portion comprises a plain light bulb covered by a flexible outer coating in the shape of a candle flame. Each set of light bulbs includes a color or scent associated with a different holiday or season.

According to a further aspect of an embodiment of the present invention, a method for making a decorative light string assembly includes coating a plurality of plain light bulbs with a polymeric gel to form a like plurality of decorative light bulbs having flexible outer coverings in the shape of candle flames. Each plain light bulb draws between about 1 watts and 4 watts when energized. The method further includes mating each of the decorative light bulbs in a light bulb socket of an extension cord to electrically interconnect the decorative light bulbs. The electrical cord has at least one end terminated by an electrical connector.

These and other benefits and features of embodiments of the invention will be apparent upon consideration of the following detailed description of preferred embodiments thereof, presented in connection with the following drawings in which like reference numerals are used to identify like elements throughout.

BRIEF DESCRIPTION OF THE DRAWINGS

FIG. 1 is front elevation view of a string of candle lights in accordance with an embodiment of the present invention.

FIG. 2 is an enlarged front elevation view of an individual candle light.

FIG. 3 is an enlarged, cross-sectional view through the candle light of FIG. 2 taken along the line 3—3 in FIG. 2.

Figure 4:
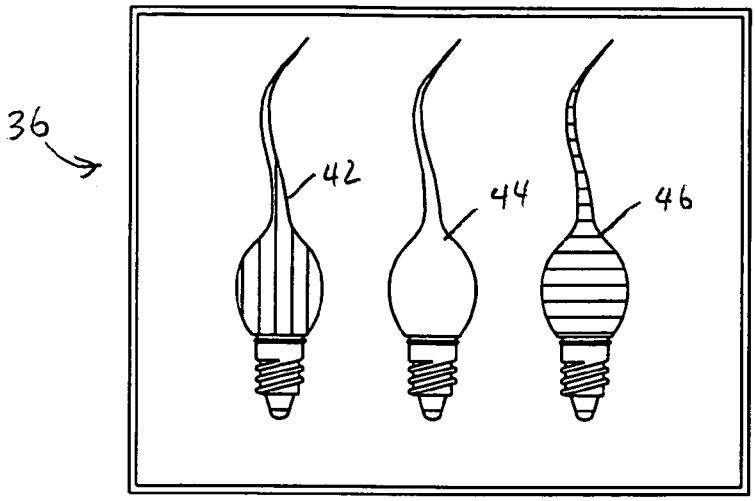
FIG. 4 is a first embodiment of a package of candle lights adapted for mounting in a light string.

Before explaining several preferred embodiments of the present invention in detail it is noted that the invention is not limited to the details of construction or the arrangement of components set forth below or illustrated in the drawings. The invention is capable of other embodiments and being practiced or carried out in various ways. It is also noted that the phraseology and terminology employed herein is for purposes of description only and should not be regarded as limiting.

DETAILED DESCRIPTION OF THE PREFERRED EMBODIMENTS

The particulars shown herein are by way of example and for purposes of illustrative discussion of the embodiments of the present invention only and are presented in a manner that is believed to provide the most useful and readily understood description of the principles and concepts of the present invention. In this regard, no attempt is made to show structural details of the present invention in more detail than is necessary to provide a fundamental understanding of the present invention. The description of the invention taken with the drawings is believed sufficient to make it apparent to those skilled in the art how several forms of the present invention may be embodied in practice.

Turning now to the drawings and referring initially to FIG. 1, a decorative light string assembly 10 is shown in accordance with a preferred embodiment of the present invention. Light string assembly 10 includes a plurality of decorative lights 12A, 12B and 12C, which are electrically and physically interconnected by an electrical cord 14. Electrical cord 14 includes a plurality of light bulb sockets 16A, 16B and 16C, which are spaced at various locations along the length of electrical cord 14 between an electrical plug 18 at one end and an electrical receptacle 20 at an opposite end. Light bulb sockets 16A, 16B and 16C may have decorative exterior appearances (e.g., they may be shaped as candles), or somewhat more plain appearances (as illustrated).

Referring now to FIG. 2, each decorative light 12 comprises a visible decorative portion 22 and a base portion 24 configured for mating with one of the light bulb sockets 16A, 16B, 16C. In the illustrated embodiment, base portion 24 is shown as a standard screw type light bulb base. However, base portion 24 could be a press-in type base or any other type of light bulb base that is well known to persons skilled in the art.

As best illustrated by FIG. 3, decorative portion 22 preferably comprises a flexible outer coating 26 that is applied over an inner bulb 28. Preferably, inner bulb 28 is made from glass. However, inner bulb 28 could be made from plastic or any other relatively rigid and sufficiently transparent material that is well known to persons skilled in the art. Moreover, inner bulb 28 should have a sufficiently low power consumption rating that the specified electrical capacity of electrical cord 14 is not exceeded when the desired number of decorative lights 12 are mated in sockets 16 and connected to a power source. By way of example and not limitation, each inner bulb 28 may have power consumption rating of between about 1 and 4 watts, and more preferably between about 2 and 3 watts.

Still referring to FIG. 3, flexible outer coating 26 preferably comprises an flexible elastomeric substance or polymer 30. One example of a material that is particularly well suited for making candle bulbs is silicon gel. However, numerous other polymers could be used so long as they are capable of assuming and resiliently retaining the desired shape (i.e., that of a candle flame) while also allowing the desired amount of light transmission. According to a preferred embodiment, substance 30 may be applied to each inner bulb 28 by a dipping technique. Of course, persons skilled in the art will appreciate that numerous other coating methods and techniques could be used and will depend in large part upon the specific coating material that is used.

In the illustrated embodiment, particles of colored pigments 32 and/or scents 34 are interspersed throughout substance 30 to alter or enhance the ambience provided by light string assembly 10. As persons skilled in the art will appreciate, particles 32 and/or 34 may be in either liquid or solid form. Moreover, particles 32 and/or 34 could be applied to the exterior surface of substance 30 rather than interspersed therein.

Figure 5:
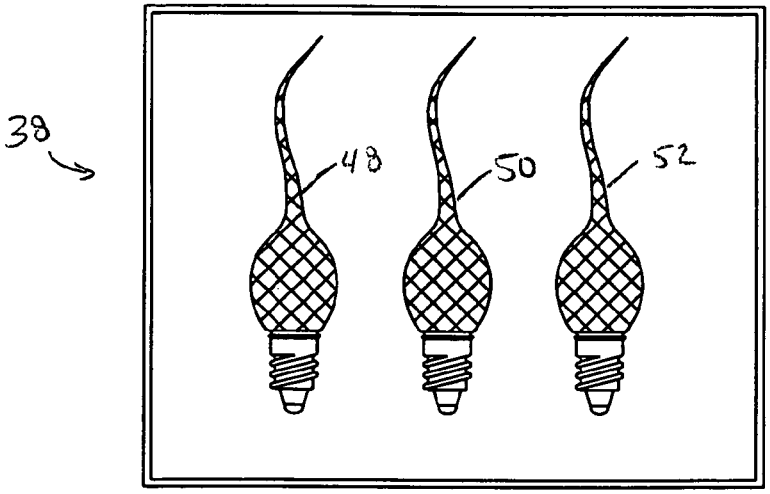
FIG. 5 is a second embodiment of a package of candle lights adapted for mounting in a light string.
Figure 6:
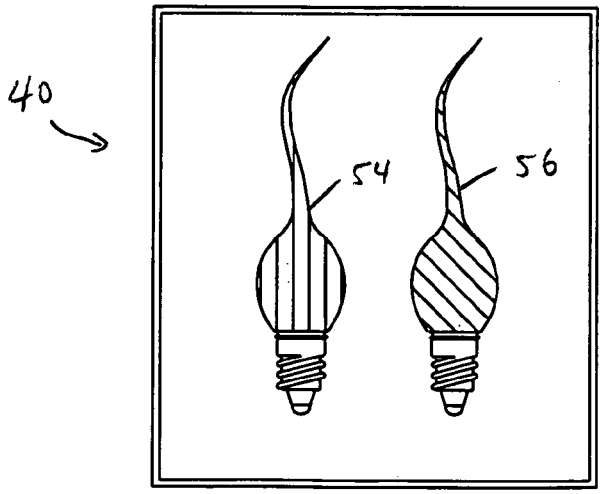
FIG. 6 is a third embodiment of a package of candle lights adapted for mounting in a light string.

Turning now to FIGS. 4–6, three different sets 36, 38, and 40 of candle bulbs are shown for use during particularly holidays. By way of example and not limitation, light set 36 includes red, white and blue candle bulbs 42, 44 and 46, which colors are typically associated with the July Fourth holiday. As another example, light set 38 includes orange bulbs 48, 50 and 52, which color is most closely associated with Halloween but also with the fall season in general. As a further example, light set 40 includes red and green bulbs 54 and 56, respectively, which colors are typically associated with the Christmas holiday. Persons skilled in the art will recognize that other colors or combinations of colors could be used for other holidays, seasons or occasions, such as the colors red and white for Valentine's Day.

In addition to color, each of the forgoing light bulb sets 36, 38, and 40 or other sets could be provided with scents representative of particular holidays, seasons or occasions. As one example, the light bulbs in set 40 could be scented with evergreen or peppermint to enhance the association with Christmas. As another example, the light bulbs in set 38 could be scented with pumpkin pie to enhance the association with Halloween in particular or the fall harvest season in general.

It is important to note that the above described and preferred embodiments of the present invention are illustrative only. Although the invention has been described in conjunction with specific embodiments thereof, those skilled in the art will appreciate that numerous modifications are possible without materially departing from the novel teachings and advantages of the subject matter described herein. Accordingly, various substitutions, modifications, changes and omissions may be made in the design, operating conditions and arrangement of the preferred and other exemplary embodiments without departing from the spirit of the present invention which is defined by the following claims.

What is claimed is:

1. A decorative light string assembly, comprising:

a string of light bulb sockets electrically interconnected by an electrical cord and terminated by at least one electrical connector; and a plurality of decorative light bulbs mated with the sockets, each decorative light bulb comprising a plain light bulb covered by a flexible outer coating in the shape of a candle flame and including a scent.

2. The light string assembly of claim 1, wherein the flexible outer coating includes a colored pigment.

3. The light string assembly of claim 2, wherein the at least one of a colored pigment is representative of a holiday or season.

4. The light string assembly of claim 3, wherein the flexible outer covering includes colored pigment selected from red, white and blue for July Fourth, red and green for Christmas, red and white for Valentine's Day and orange for Halloween.

5. The light string assembly of claim 1, wherein the flexible outer covering includes scent selected from vanilla, cinnamon, raspberry, cranberry, pumpkin pie and apple pie.

6. The light string assembly of claim 1, wherein the flexible outer coating is a polymer.

7. The light string assembly of claim 6, wherein at least one of a colored pigment and a scent is dispersed throughout the polymer.

8. The light string assembly of claim 6, wherein the polymer is silicon gel.

9. The light string assembly of claim 1, wherein each plain light bulb draws between about 1 and 4 watts when energized.

10. The light string assembly of claim 9, wherein each plain light bulb draws between about 2 and 3 watts when energized.

11. The light string assembly of claim 1, wherein the scent is representative of a holiday or season.

12. The light string assembly of claim 1, wherein the flexible outer coating on a first portion of the plurality of decorative light bulbs includes one or more first pigments so as to have a first color and wherein the flexible outer coating on a second portion of the plurality of decorative light bulbs includes one or more second pigments so as to have a second color.

13. The light string assembly of claim 12, wherein the first color and the second color together are representative of a holiday or season.

14. A decorative light string assembly kit, comprising:

a string of light bulb sockets electrically interconnected by an electrical cord and terminated by at least one electrical connector; and at least two sets of decorative light bulbs, each decorative light bulb comprising a decorative portion and a socket portion configured for mating with one of the sockets, wherein each decorative light bulb comprises a plain light bulb covered by a flexible outer coating in the shape of a candle flame, wherein each set of decorative light bulbs includes a color or scent associated with a different holiday or season, wherein the flexible outer coating includes a scent dispersed therein.

15. The light string assembly kit of claim 14, wherein the color is provided by mixing a colored pigment into the flexible outer coating.

16. The light string assembly kit of claim 15, wherein the colored pigment is selected from red, white and blue for July Fourth, red and green for Christmas, red and white for Valentine's Day, and orange for Halloween.

17. The light string assembly kit of claim 14, wherein the scent is selected from vanilla, cinnamon, orange and apple pie.

18. The light string assembly kit of claim 14, wherein the flexible outer coating is a polymer.

19. The light string assembly kit of claim 18, wherein the polymer is silicon gel.

20. The light string assembly kit of claim 14, wherein each plain light bulb draws between about 1 and 4 watts when energized.

21. The light string assembly kit of claim 20, wherein each plain light bulb draws between about 2 and 3 watts when energized.

22. A method for making a decorative light string assembly, comprising:

coating a plurality of plain light bulbs with a polymeric gel to form a like plurality of decorative light bulbs, each plain light bulb drawing between about 1 watts and 4 watts when energized;

mating each of the decorative light bulbs in a light bulb socket of an electrical cord to electrically interconnect the light bulbs, the electrical cord having at least one end terminated by an electrical connector; and applying a scent to the polymeric gel of at least one of the bulbs.

23. The method of claim 22, further including applying a color to at least one of the light bulbs.

24. The method of claim 23, further including selecting the scent based on a particular holiday.

25. The method of claim 23, wherein the applying color step is performed by mixing a colored pigment into the gel prior to coating.

26. The method of claim 23, further including selecting the color based on a particular holiday.

27. The method of claim 22, wherein the applying step is performed by mixing a scent into the gel prior to the coating.

28. The method of claim 22, further including applying a first color to the polymeric gel on a first portion of the plurality of light bulbs and a second color to the polymeric gel on a second portion of the plurality of light bulbs.

29. The method of claim 28, further including selecting the first color and the second color based on a particular holiday or season.

30. The method of claim 22, wherein the coating step is performed by dipping the plain light bulbs in the gel.

* * * * *